US010283301B2

(12) United States Patent
Schuster

(10) Patent No.: US 10,283,301 B2
(45) Date of Patent: May 7, 2019

(54) ELECTROMAGNETIC ACTUATOR AND CIRCUIT BREAKER COMPRISING SUCH AN ACTUATOR

(71) Applicant: SCHNEIDER ELECTRIC INDUSTRIES SAS, Rueil-Malmaison (FR)

(72) Inventor: Philippe Schuster, Grenoble (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 15/519,735

(22) PCT Filed: Nov. 10, 2015

(86) PCT No.: PCT/EP2015/076163
§ 371 (c)(1),
(2) Date: Apr. 17, 2017

(87) PCT Pub. No.: WO2016/075118
PCT Pub. Date: May 19, 2016

(65) Prior Publication Data

US 2017/0263404 A1 Sep. 14, 2017

(30) Foreign Application Priority Data

Nov. 12, 2014 (FR) ..... 14 60896

(51) Int. Cl.
*H01F 7/08* (2006.01)
*H01H 71/40* (2006.01)
(Continued)

(52) U.S. Cl.
CPC ..... *H01H 71/402* (2013.01); *H01H 71/0207* (2013.01); *H01H 71/142* (2013.01);
(Continued)

(58) Field of Classification Search
CPC ..... H01H 71/402; H01H 71/0207; H01H 71/142; H01H 71/2454; H01H 71/2463
(Continued)

(56) References Cited

U.S. PATENT DOCUMENTS 2,690,528 A * 9/1954 Wilckens ..... H01H 71/345 335/174
3,806,850 A * 4/1974 McFarlin ..... H01H 50/20 335/203
(Continued)

FOREIGN PATENT DOCUMENTS

AU 2012220430 10/2013
DE 30 28 900 A1 2/1962
(Continued)

OTHER PUBLICATIONS

International Search Report dated Jan. 26, 2016 in PCT/EP2015/076163 Filed Nov. 10, 2015.

*Primary Examiner* — Shawki S Ismail
*Assistant Examiner* — Lisa N Homza
(74) *Attorney, Agent, or Firm* — Oblon, McClelland, Maier & Neustadt, L.L.P.

(57) ABSTRACT

An electromagnetic actuator including a magnetic housing, a coil that is rigidly connected to the housing and is capable of being connected to an electric circuit, a magnetic core that is arranged in the coil and can move along a central axis defined by the coil and according to the strength of the current flowing in the coil, and a shunt that is arranged in the coil and includes a magnetocaloric material the magnetisation of which is temperature-dependent. The shunt is arranged in the coil along the central axis along a length so as to create an air gap between the shunt and the magnetic core. The actuator further includes a device for attaching the shunt to the housing that are designed to adjust the length.

12 Claims, 3 Drawing Sheets

(51) Int. Cl.
*H01H 71/14* (2006.01)
*H01H 71/24* (2006.01)
*H01H 71/02* (2006.01)

(52) U.S. Cl.
CPC .... *H01H 71/2454* (2013.01); *H01H 71/2463* (2013.01); *H01H 71/40* (2013.01); *H01H 2071/407* (2013.01); *H01H 2235/01* (2013.01)

(58) Field of Classification Search
USPC ..... 335/220
See application file for complete search history.

(56) References Cited

U.S. PATENT DOCUMENTS 4,251,052 A * 2/1981 Hertfelder ..... H01F 7/1607 251/129.02
4,840,059 A * 6/1989 Okada ..... F02M 51/0678 73/114.47
6,154,115 A 11/2000 Flohr
8,154,115 B1 * 4/2012 Chan ..... B81B 7/007 257/704
8,519,811 B2 * 8/2013 Sugisawa ..... H01H 1/54 335/177
9,702,190 B2 * 7/2017 Schneider ..... E06B 9/72
2013/0088312 A1 * 4/2013 Isonaga ..... H01H 50/20 335/192
2013/0093542 A1 * 4/2013 Sora ..... H01F 7/1607 335/192
2015/0318135 A1 * 11/2015 Schuster ..... H01H 50/16 335/43

FOREIGN PATENT DOCUMENTS

EP 1 001 444 A2 5/2000
FR 2 772 981 A1 6/1999
WO 00/74097 A1 12/2000
WO 2012/114037 A1 8/2012
WO 2014/087073 A1 6/2014

* cited by examiner

ELECTROMAGNETIC ACTUATOR AND CIRCUIT BREAKER COMPRISING SUCH AN ACTUATOR

The invention relates to an electromagnetic actuator, and to a circuit breaker comprising such an actuator.

In the domain of protecting electrical circuits, the use is known of a circuit breaker including a thermal actuator for detecting an overload current, or including a magnetic actuator in order to recognize a short circuit current. As an example, the document FR-A-2 772 981 can be mentioned, where the circuit breaker is equipped with a thermal actuator. In particular, the actuator comprises a straight bimetal strip and an electromagnet with a solenoid plunger.

It is also known to combine the two functions, thermal and magnetic, in a single actuator, so as to combine in a single circuit breaker the detection of overload and short circuit currents. For this reason, it is known, for example from EP-A-1 001 444, to equip an actuator with a rounded bimetal strip. It is also known, for example from U.S. Pat. No. 2,690,528, to equip an actuator with a system with dashspots, which functions differently during an overload or short circuit current. The aforementioned actuators have the advantage of reducing the size and the number of parts. However, the dynamics of opening the contacts of such actuators do not make it possible to strike the contacts. The result is that the opening speed is relatively slow compared with the required cutoff power.

The use is furthermore known, from DE-A-3 028 900 and WO-A-2014/087073, of an actuator equipped with a shunt device, which includes a magnetocaloric material and a solenoid plunger. Such an actuator allows the opening speed of the contacts to be increased by striking or extracting them. In contrast, the structure of this actuator fixes the trigger thresholds for protecting the circuit. The thresholds cannot be adapted to the different electrical circuits, which limits the fields of use that of such a device.

This is the disadvantage that the invention means more particularly to remedy, by proposing a new electromagnetic actuator, the trigger thresholds of which are adjustable, for example depending on the use context.

In this spirit, the invention relates to an electromagnetic actuator comprising a magnetic field frame and a coil secured to the field frame and which can be linked to an electrical circuit. The actuator also comprises a magnetic core arranged in the coil and that can move, along a central axis defined by the coil the intensity of the current flowing in the coil and a shunt device arranged in the coil and comprising a magnetocaloric material, the magnetization of which is a function of the temperature. According to the invention, the shunt device is arranged in the coil for a length, along the central axis, in such a way as to form an air gap between the shunt device and the magnetic core. The actuator further comprises means for fixing the shunt device to the field frame, designed to set this length.

Thanks to the invention, the actuator combines the advantages of the thermal and magnetic functions with those of an actuator with adjustable thresholds. In other words, such an actuator includes a reduction in size and in the number of parts, as well as a decrease of the thermal dissipation and of the number of variants to consider. The actuator furthermore makes it possible to improve in particular its sensitivity and its thermal output, as well as making it possible to increase or decrease its sensitivity to harmonic currents depending on the field of use. Finally, such an actuator also offers economic advantages, that is to say, a reduction of the quantity of necessary active materials and an easier embodiment of the actuator.

According to advantageous but not obligatory aspects of the invention, such an electromagnetic actuator can include one or more of the following features, taken in any technically admissible combination:

- The actuator further comprises a heat-conducting sheath placed in the coil and in that the magnetic core and the shunt device are arranged in the sheath.
- The shunt device is in contact with the heat conducting sheath.
- A spring is interposed between the shunt device and the magnetic core.
- The shunt device is provided with a polar part, arranged between the spring and a part of the shunt device, consisting of the magnetocaloric material.
- The heat conducting sheath has a solid wall.
- The heat conducting sheath includes a slot that extends parallel to its central axis.
- The fixing means comprise a laser weld or a mechanical locking device.
- The magnetocaloric material is an alloy of nickel, cobalt, manganese and a fourth element chosen among aluminum, indium, antimony and tin.

The invention also relates to a circuit breaker comprising a box accommodating an actuator such as described above, the coil being connected to a power line. The circuit breaker also comprises a pair of contacts that can move relative to each other, a first one of these contacts being mechanically linked with the moving core of the actuator.

The invention will be better understood and other advantages of it will appear more clearly in the light of the description that will follow, given only as a non-limitative example and made with reference to the attached drawings, in which.

Figure 1:
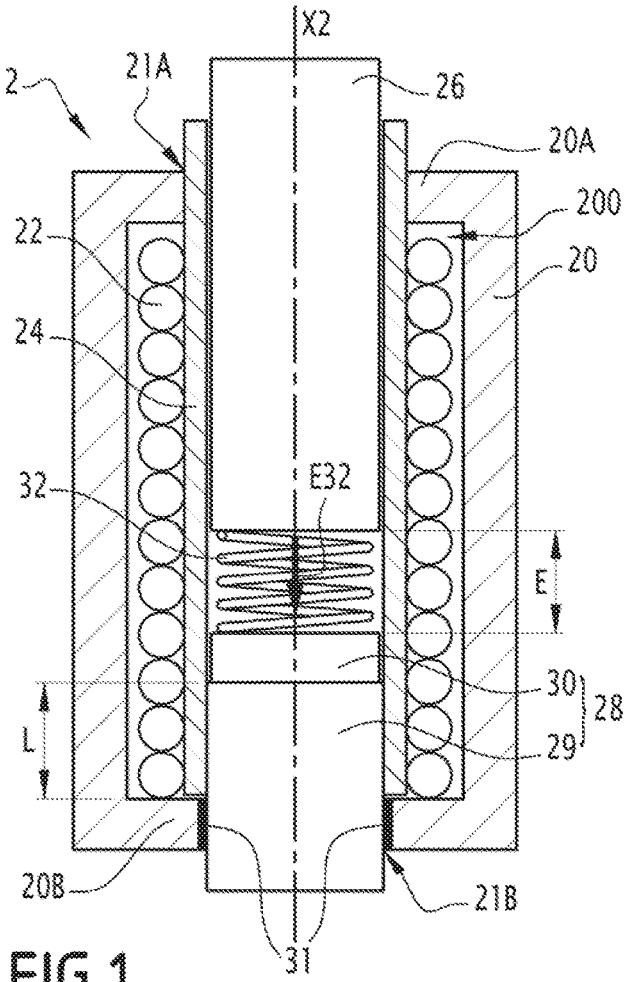
FIG. 1 is a diagrammatic view of an actuator according to the invention.

FIG. 1 shows an electromagnetic actuator 2 comprising a magnetic field frame 20 that defines a central axis X2 of the actuator. The central axis X2 is fixed and constitutes a central axis for all the units of the actuator 2. The magnetic field frame 20 is, for example, of a tubular shape and has two axially opposite bases 20A and 208. A bore, respectively 21A and 218, is provided in each of these bases 20A and 20B. The bores 21A and 218 allow access to a volume 200 internal to the field frame 20.

The actuator 2 also comprises a coil 22, arranged in the volume 200 of the field frame 20 and secured to the field frame 20. The coil 22 can be linked, in a manner known in the art, to an electrical circuit that is not illustrated in FIG. 1.

Figure 2:
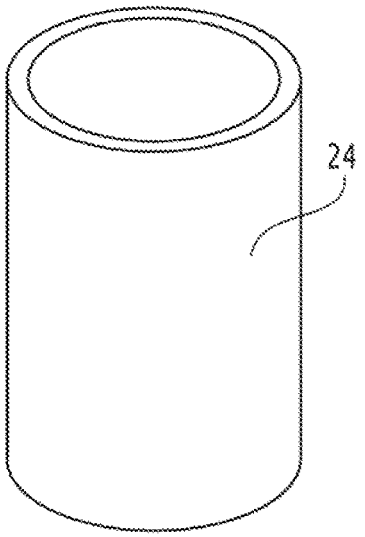
FIG. 2 is a perspective view of a heat conducting sheath of the actuator of FIG. 1.

The actuator 2 further comprises a heat conducting sheath 24. As shown in FIG. 2, the sheath 24 has a hollow cylindrical shape with a solid wall. The sheath 24 is placed in the coil 22 and in radial contact with it, along the axis X2. On the base 20A side, the sheath 24 passes through the bore 21A. A terminal part of the sheath 24 protrudes relative to the base 20A and outside the field frame 20.

The main function of the sheath is to transmit heat. It is therefore in metal.

The actuator 2 also comprises a magnetic core 26 of a cylindrical shape, arranged in the sheath 24 and able to move in translation along the central axis X2 as a function of the intensity of the current flowing in the coil 22.

The actuator 2 further comprises a shunt device 28 including a magnetocaloric material 29, in the form of a corresponding part, the magnetization of which is a function of the temperature. The shunt device 28 has a cylindrical shape and is partially arranged in the sheath 24 along a length L, along the central axis X2, forming along the central axis X2 an air gap E between the shunt device 28 and the core 26. The shunt device 28 is consequently arranged in part in the bore 218 of the field frame 20, the remaining portion being positioned outside the field frame 20, protruding relative to the base 206. The shunt device 28 is furthermore in contact with the heat conducting sheath 24.

In practice, in a state prior to utilization, typically during manufacturing of the actuator 2, the shunt device 28 can move in translation along the axis X2 relative to the sheath 24 and to the field frame 20. It is therefore possible to choose the value of the length L and, as described below, a switching threshold of the actuator 2 due to the corresponding variation of the air gap E. The actuator also comprises means 31 for fixing the shunt device 28 to the field frame 20, the fixing means 31 being designed to set this length L. In particular, the fixing means 31 are embodied by a laser weld or by a mechanical locking device.

Figure 8:
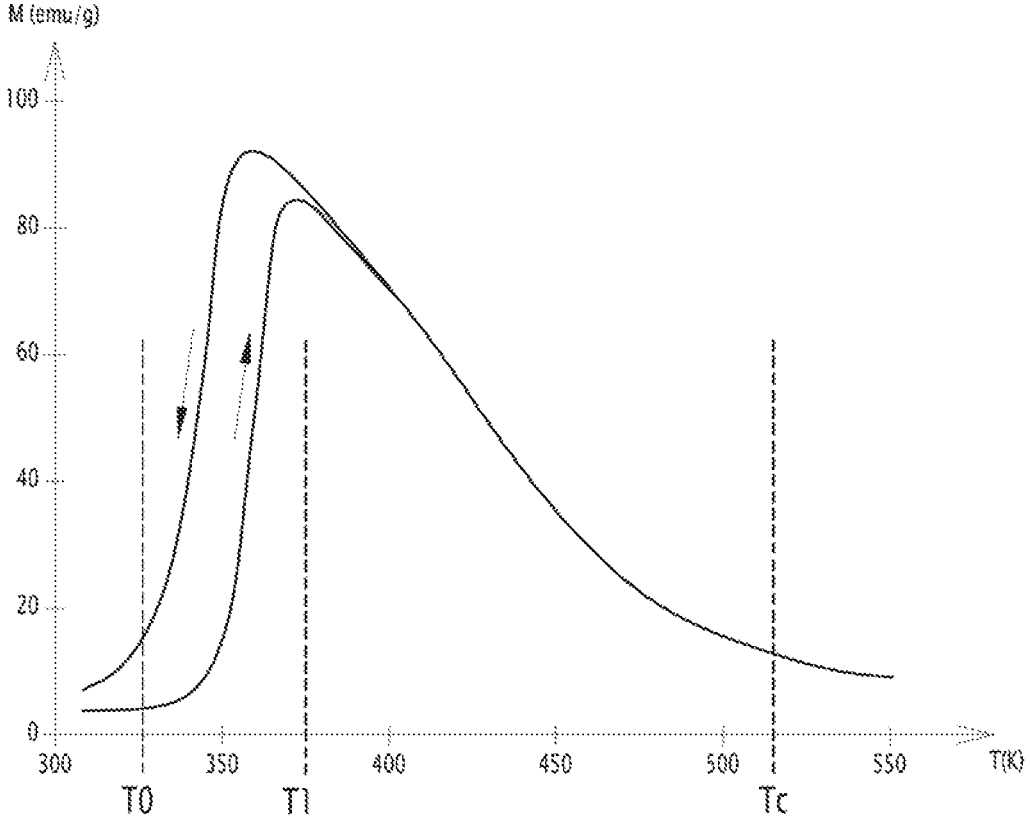
FIG. 8 is a diagram illustrating the magnetization of a shunt device according to the invention as a function of its temperature and the magnetic field.

The magnetocaloric material 29 of the shunt device 28 is an alloy of nickel, cobalt, manganese and a fourth element chosen among aluminum, indium, antimony and tin. The shunt device material 29 is chosen for its magnetocaloric properties. More precisely, as shown in FIG. 8, the magnetocaloric material 28 is such that its magnetization peaks as a function of the temperature T. In particular, at low temperature, the material is weakly, perhaps not, magnetic. When the temperature T rises beyond a first temperature T0, the magnetization of the magnetocaloric material 29 increases rapidly, reaching a maximum at a second temperature T1, beyond which magnetization decreases until it is nullified at the Curie temperature Tc of the magnetocaloric material 29. For further clarification, the reader may refer to WO-A-2014/087073.

In a preferred embodiment of the invention, the shunt device 28 is provided with a polar part 30 arranged in the sheath 24 and placed between the part consisting of the magnetocaloric material 29 of the shunt device 28 and the core 26, the air gap E thus being delimited between this polar part 30 and the magnetic core 26. As shown in FIG. 1, the polar part 30 bears, along the axis X2, on the magnetocaloric material 29 of the shunt device 28.

Finally, the actuator 2 comprises a spring 32, placed, along the axis X2, between the polar part 30 and the magnetic core 26.

Figure 3:
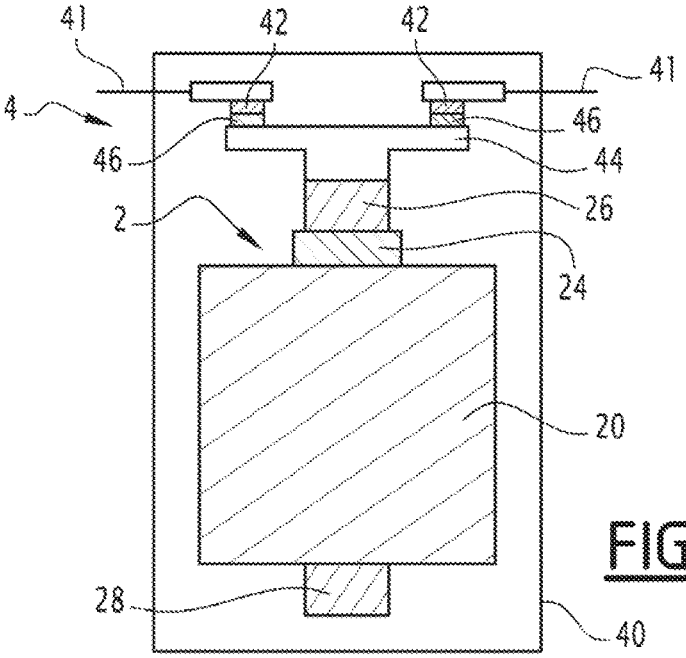
FIG. 3 is a diagrammatic view of a circuit breaker according to the invention, comprising an actuator according to the invention.

In FIG. 3, a circuit breaker 4 comprises a box 40 that accommodates the actuator 2. In the circuit breaker 4, the coil 22 of the actuator 2 is connected to a power line 41 of an electrical circuit. The power line 41 has two first fixed contact pads 42. The circuit breaker 4 also comprises bridge 44 secured to the magnetic core 26 of the actuator 2 and equipped with two second contact pads 46. The bridge 44 can, as a result, move in translation along the axis X2 of the actuator 2 with the core 26, and is able to move between a first position, shown in FIG. 3, where the second contact pads 46 are in contact with the first contact pads 42, and a second position where the second contact pads 46 are distanced from the first contact pads 42. The first position corresponds to the closed configuration of the circuit breaker 4, while the second position corresponds to the open configuration of the circuit breaker 4.

The functioning of the electromagnetic actuator 2 and of the circuit breaker 4 is as follows. Before installing the actuator 2 in the circuit breaker 4, in particular during manufacturing of the actuator, the shunt device 28 is inserted in the heat conducting sheath 24 along the length L, then is fixed to the field frame 20 by the aforementioned fixing means 31. This length L is chosen according to the field of use of the circuit breaker 4. In fact, as explained below, the length L makes it possible to choose the switching threshold of the actuator 2 and hence the trigger threshold of the circuit breaker 4.

In the assembled and dosed configuration of the circuit breaker 4, as shown in FIG. 3, the spring 32 exerts on the core 26 a load E32, shown in FIG. 1, so as to pull the moving contact pads 46 of the bridge 44 to distance them from the fixed contact pads 42 and thus to ensure that the electrical circuit opens.

Figures 4, 5, 6:
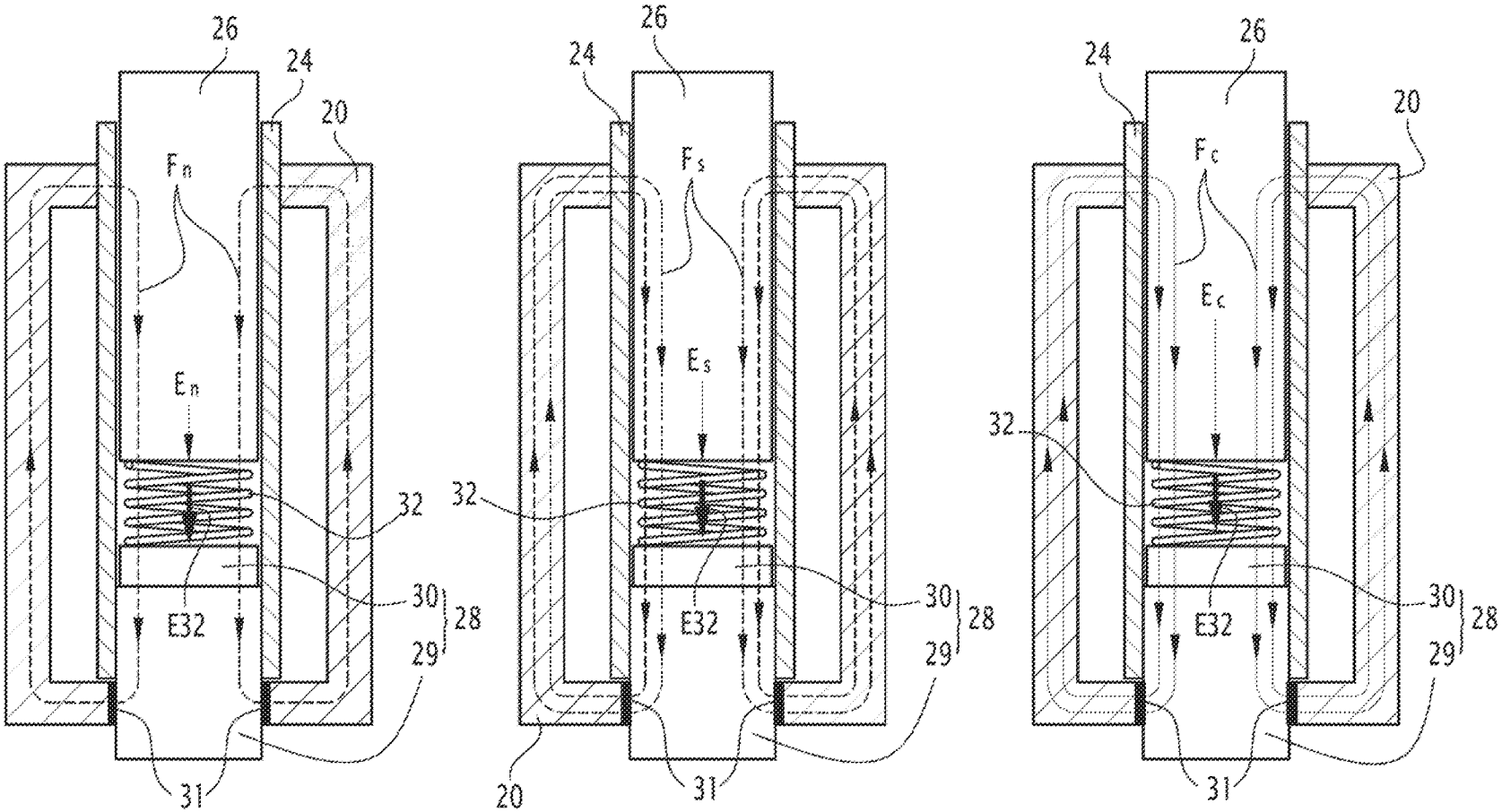
FIG. 4 is a diagrammatic illustration of the actuator of FIG. 1 when a rated current powers the coil, which is omitted for clarity of the drawing.
FIG. 5 is a view similar to FIG. 4 when an overload current powers the coil.
FIG. 6 is a view similar to FIG. 4 when a short circuit current powers the coil.

In a normal condition of utilization, as shown in FIG. 4, a current, called rated current, flows in the circuit to which the coil 22 is connected. In a manner known in the art, the coil 22 then creates a magnetic flux Fn.

The actuator 2 is thus configured to constitute a magnetic circuit. In particular, the magnetic circuit consists of the parts 30, 28, 20, 24, 26 and the air gap E between the core 26 and the polar part 30 of the shunt device 28. In the magnetic circuit, the function of the polar part 30 is, on one hand, to channel the magnetic flux Fn between the moving core 26 and the magnetocaloric material 29, and on the other, to protect the latter against impacts when the air gap E closes.

All the aforementioned parts have a fixed magnetic reluctance, except for the shunt device 28. In the temperature interval where the magnetization of the device 28 increases, its reluctance decreases while facilitating the passage of the magnetic flux.

The magnetic core 26, with the magnetic flux Fn passing though it along the central axis X2, is exposed to a magnetic load En, dependent upon the magnetic flux Fn and, in a manner known in the art, in close correlation with the current flowing in the coil 22. The magnetic core 26 thus exerts its load En on the spring 32.

The coil 22 generates heat dissipation, in particular by Joule effect. The sheath 24 is responsible for transmitting this dissipated heat to the other parts of the actuator and in particular to the shunt device 28, the magnetization of which is a function of its temperature. The sheath 24 is furthermore itself responsible for heat dissipation due to currents flowing in its surfaces and which are induced by the magnetic flux Fn.

In a normal condition of utilization, the overall heat dissipation due to the rated current induces an increase of the temperature T, which nevertheless remains below the aforementioned first temperature T0. The magnetization of the shunt device 28 remains nil or very low. Thus, with a rated current, the load En is less than or equal to the load E32 of the spring 32, such that the magnetic core 26 does not move and the closed configuration of the circuit breaker 4 is maintained.

When an overload current flows in the electrical circuit, as shown in FIG. 5, a magnetic flux Fs surrounds the coil 22 as described above. The current flow is considered, for example, as having a value more than or equal to 1.5 times the value of the rated current. The magnetic flux Fs generated by such an overload current is therefore considerably greater than the magnetic flux Fn generated by the rated current. This overload current furthermore provokes an increase of the heat dissipation by Joule effect of the coil 22. Such heat dissipation is transmitted via the heat conducting sheath 24 to the shunt device 28. The shunt device 28 is therefore brought to a temperature increase and to acquire a temperature T situated between the aforementioned first and second temperatures. This temperature thus allows a more significant magnetization of the shunt device 28, and hence a decrease of its magnetic reluctance. In practice, the magnetic circuit for the overload current has an overall magnetic reluctance lower than that in the case of the rated current. The magnetic flux Fs then exerts a load Es on the on the magnetic core 26. The core 26 compresses the spring 32, which opposes its load E32. In this case, the load Es is greater than the load E32 of the spring and the core 26 is placed in translation along the axis X2 and reduces the air gap E. The movement of the core 26 at the circuit breaker 4 triggers the moving bridge 44 and its contact pads 46, distancing them from the fixed contact pads 42. The circuit breaker 4 is then in its open configuration.

The transmission of heat depends in particular on time. The temperature increase is not instantaneous but happens progressively. In other words, the magnetization of the device 28 increases in time with the temperature. The load Es exerted by the core 26 on the spring 32 in turn progressively increases in time in parallel with the temperature increase of the shunt device 28. A threshold temperature can be considered, beyond which the load Es is greater than the load E32 of the spring 32. The movement of the core 26 and the opening of the contact pads 42 and 46 of the circuit breaker 4 will be possible when the temperature T of the device 28 exceeds the threshold temperature.

When a short circuit current flows in the electrical circuit, as shown in FIG. 6, a magnetic flux Fc is generated. If the short circuit current is considered, for example, to be greater than or equal to five times the rated current, the magnetic flux Fc is notably greater than the magnetic flux Fn. In other words, the short circuit current provokes a significant increase of the magnetization of the shunt device 28 whatever its temperature, and the magnetic flux Fc exerts on the core 26 a load Ec, which is immediately greater than the load E32 of the spring 32. In this case, the magnetic flux Fc is capable of moving the core 26 without waiting for the heat transmission between the coil 22 and the shunt device 28. As a result, the short circuit current almost instantaneously provokes a movement of the core 26 along the axis X2 so as to reduce the air gap E and to compress the spring 32, and, at the circuit breaker 4, to open the contact pads 42 and 46.

In the case where the actuator 2 intervenes to open the contact pads 42 and 48 when a short circuit current flows in the electrical circuit, the magnetic load generated by the coil 22 is such that it provokes the opening very quickly: this triggers a limitation of the short circuit current.

The reluctance of the shunt device 28, and hence of the whole magnetic circuit, depends on the length L of the device 28 relative to the sheath 24. The length L plays an important part in the functioning of the circuit breaker 4. This length L defines the part of the shunt device 28 that is a part of the magnetic circuit. The length L thus defines the part of the shunt device 28 that is in contact with the sheath 24 and hence directly exposed to the transmission of heat.

If the position of the core 26 is considered to be fixed when the length L is reduced, the air gap E increases and consequently the overall reluctance of the magnetic circuit increases. For the load of the core 26 to be greater than the load E32 of the spring 32, a greater degree of magnetization of the device 28 must be achieved, that is to say, a higher threshold temperature. In other words, by reducing the length L, it is possible to delay the trigger threshold of the circuit breaker 4.

On the contrary, by increasing the length L, the air gap E decreases, together with the overall reluctance of the magnetic circuit. The threshold temperature is then lower. In other words, by increasing the length, it is possible to bring forward the trigger threshold of the circuit breaker 4.

Figure 7:
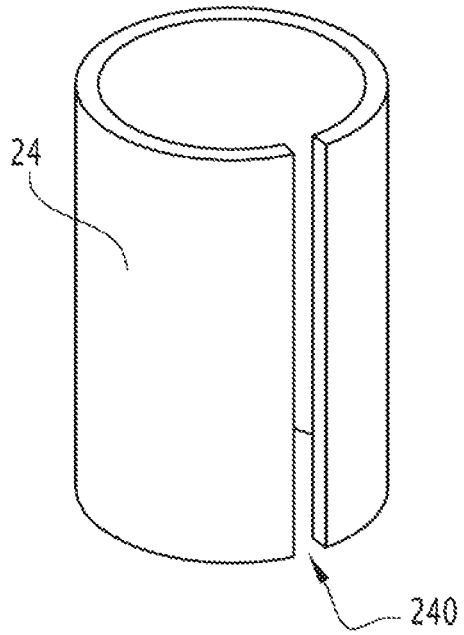
FIG. 7 is a view similar to FIG. 2 according to a variant embodiment of the invention.

Diverse developments and variants of the actuator 2 can furthermore be envisaged. As examples:

- the polar part 30 has a hollow cylindrical shape therefore including a bore in which the spring 32 is partially arranged, which therefore bears on the magnetocaloric material 29 of the shunt device 28 and the magnetic core 26;
- the heat conducting sheath 24 includes a slot 240, as shown in FIG. 7, which extends parallel to the central axis X2. The slot 240 creates a cutoff for the currents generated by electromagnetic induction in the sheath 24. The presence of the slot 240 therefore allows the trigger threshold to be delayed. The choice of using or not using a sheath 24 with the slot 240 therefore depends on the field of use utilization of the circuit breaker 4.

The embodiment and the variants envisaged above can be mutually combined in order to generate new embodiments.

The invention claimed is:

1. An electromagnetic actuator configured to be disposed in a circuit breaker, comprising:

a magnetic field frame, a coil secured to the field frame and which is configured to connect to a power line of an electrical circuit, a magnetic core arranged in the coil and that can move, along a central axis defined by the coil as a function of the intensity of the current flowing in the coil, wherein the magnetic core is configured to be coupled to a movable structure which is configured to open and close the electric circuit; and a shunt device arranged in the coil and comprising a magnetocaloric material, the magnetization of which is a function of the temperature, wherein the shunt device is arranged in the coil for a length, along the central axis, in such a way as to form an air gap between the shunt device and the magnetic core, the actuator further comprising means for fixing the shunt device to the field frame, designed to set this length, wherein a reluctance of the shunt device is dependent on the length such that the trigger threshold of the circuit breaker is dependent upon the length.

2. The actuator as claimed in claim 1, wherein the actuator further comprises a heat conducting sheath placed in the coil and wherein the magnetic core and the shunt device are arranged in the sheath.

3. The actuator as claimed in claim 2, wherein the shunt device is in contact with the heat conducting sheath.

4. The actuator as claimed in claim 2, wherein the heat conducting sheath has a solid wall.

5. The actuator as claimed in claim 2, wherein the heat conducting sheath comprises a slot that extends parallel to its central axis.

6. The actuator as claimed in claim 1, wherein a spring is interposed between the shunt device and the magnetic core.

7. The actuator as claimed in claim 6, wherein the shunt device is provided with a polar part, arranged between the spring and a part of the shunt device, consisting of the magnetocaloric material.

8. The actuator as claimed in claim 1, wherein the fixing means include a laser weld or a mechanical locking device.

9. The actuator as claimed in claim 1, wherein the magnetocaloric material is an alloy of nickel, cobalt, manganese and a fourth element chosen among aluminum, indium, antimony and tin.

10. A circuit breaker comprising a box accommodating an actuator as claimed in claim 1, the coil of the actuator being connected to a power line, and a pair of contacts that can move relative to each other, a first one of the contacts being mechanically linked with the magnetic core of the actuator.

11. An electromagnetic actuator, comprising:

a magnetic field frame, a coil secured to the field frame and which can be linked to an electrical circuit, a magnetic core arranged in the coil and that can move, along a central axis defined by the coil as a function of the intensity of the current flowing in the coil; and a shunt device arranged in the coil and comprising a magnetocaloric material, the magnetization of which is a function of the temperature, wherein the shunt device is arranged in the coil for a length, along the central axis, in such a way as to form an air gap between the shunt device and the magnetic core, the actuator further comprising means for fixing the shunt device to the field frame, designed to set this length, wherein a spring is interposed between the shunt device and the magnetic core, and the shunt device is provided with a polar part, arranged between the spring and a part of the shunt device, consisting of the magnetocaloric material.

12. An electromagnetic actuator, comprising:

a magnetic field frame, a coil secured to the field frame and which can be linked to an electrical circuit, a magnetic core arranged in the coil and that can move, along a central axis defined by the coil as a function of the intensity of the current flowing in the coil; and a shunt device arranged in the coil and comprising a magnetocaloric material, the magnetization of which is a function of the temperature, wherein the shunt device is arranged in the coil for a length, along the central axis, in such a way as to form an air gap between the shunt device and the magnetic core, the actuator further comprising means for fixing the shunt device to the field frame, designed to set this length, wherein the magnetocaloric material is an alloy of nickel, cobalt, manganese and a fourth element chosen among aluminum, indium, antimony and tin.

* * * * *